United States Patent [19]

Dickert et al.

[11] Patent Number: 4,498,620

[45] Date of Patent: Feb. 12, 1985

[54] CARTON WITH CARRYING HANDLE

[75] Inventors: James C. Dickert, Hinsdale; Harry I. Roccaforte, Western Springs; Lawrence S. Wysocki, Chicago, all of Ill.

[73] Assignee: Champion International Corporation, Stamford, Conn.

[21] Appl. No.: 598,403

[22] Filed: Apr. 11, 1984

Related U.S. Application Data

[63] Continuation of Ser. No. 408,012, Aug. 13, 1982, abandoned.

[51] Int. Cl.[3] ..... B65D 5/46

[52] U.S. Cl. ..... 229/52 A; 229/52 AL

[58] Field of Search ..... 229/52 A, 52 AC, 52 AL, 229/52 AM, DIG. 6

[56] References Cited

U.S. PATENT DOCUMENTS

| | | | |
|---|---|---|---|
| 1,171,228 | 2/1916 | Misroch et al. | 229/52 A |
| 2,639,082 | 5/1953 | Goldsmith | 229/52 A |
| 3,315,876 | 4/1967 | Vander Jagt | 229/52 A |
| 3,774,836 | 11/1973 | Nunn | 229/52 A |
| 3,801,012 | 4/1974 | Thelen | 229/52 A |
| 4,286,714 | 9/1981 | Zdarsky | 229/52 A |

FOREIGN PATENT DOCUMENTS

| | | | |
|---|---|---|---|
| 1337049 | 7/1963 | France | 229/52 AL |

*Primary Examiner*—William Price
*Assistant Examiner*—Gary E. Elkins
*Attorney, Agent, or Firm*—Evelyn M. Sommer

[57] ABSTRACT

A carton provided with a carrying handle on the top wall. The handle comprises a plastic strip folded back on itself adjacent one end with an accordion pleat. The ends of the strip are affixed to the inner surface of the lower of two overlying flaps forming the top wall. The strip extends through complemental openings in the overlying flaps forming the top wall, and can be extended vertically because of the pleated end to form a hand hold. A pivotable panel is hingedly connected to and cut from the lower of the two overlying flaps adjacent the openings through which the handle extends to close the opening in the top wall to preclude contaminants from entering the interior of the carton through the openings.

6 Claims, 4 Drawing Figures

CARTON WITH CARRYING HANDLE

This application is a continuation of application Ser. No. 408,012 filed Aug. 13, 1982, now abandoned.

BACKGROUND OF THE INVENTION

1. Field of the Invention

This invention relates to a carton construction, and more particularly, a carton construction provided with a carrying handle on the top closure thereof for carrying the carton and its contents.

2. Description of the Prior Art

Heretofore, it has been common practice to affix a reinforced plastic handle to the top of a carton construction, e.g., a large carton filled with laundry detergent so that the carton and its contents could be conveniently carried out of a retail establishment by a purchaser. The plastic handle can be adhesively connected to the rear of a paper reinforcement mounting strip. The front of the paper mounting strip is adhesively connected to the rear or inner surface of one of the closure flaps of the carton and the handle projected through an opening in the closure flap. A complemental opening in the other closure flap also receives the handle therethrough. Alternatively, the plastic handle can be affixed directly to the rear or inner surface of the closure flap in lighter weight cartons, e.g., those used for padded diapers.

In either case, there is an opening provided through the carton flaps or paper reinforcement mounting strip through which contaminants such as dirt can pass into the interior of the carton.

SUMMARY OF THE INVENTION

Accordingly, in accordance with the present invention, a carton is provided with a carrying handle on the top wall. The handle comprises a plastic strip folded back on itself adjacent one end with an accordion pleat. The ends of the strip are affixed to the inner surface of the lower of two overlying flaps forming the top wall. The strip extends through complemental openings in the overlying flaps forming the top wall, and can be extended vertically because of the pleated end to form a hand hold. A pivotable panel is hingedly connected to and cut from the lower of the two overlying flaps adjacent the openings through which the handle extends to close the opening in the top wall to preclude contaminants from entering the interior of the carton through the openings.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
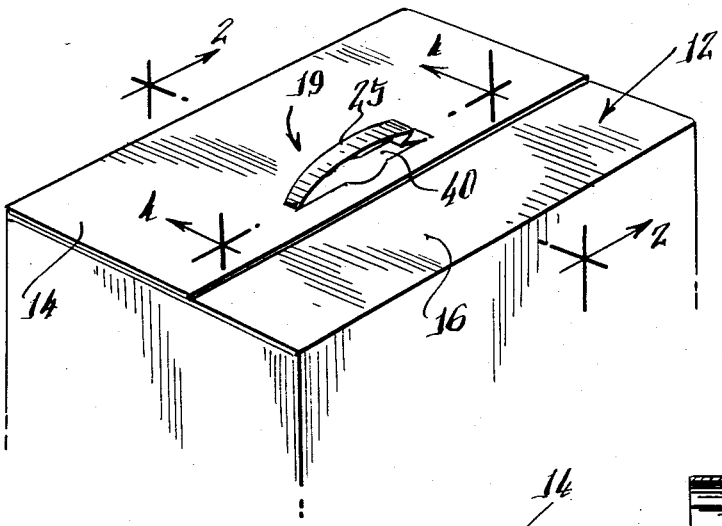
FIG. 1 is a perspective view of the top portion of the carton of the present invention.
Figure 2:
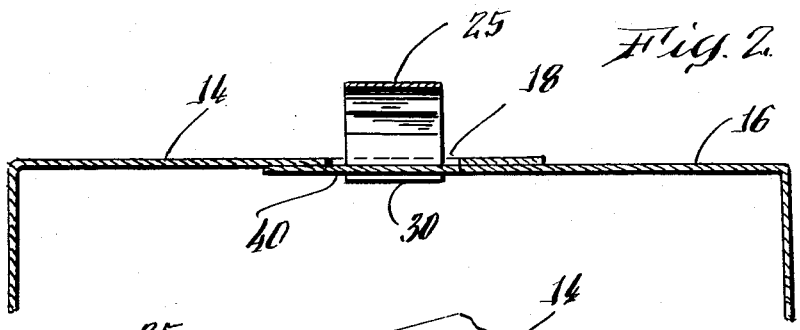
FIG. 2 is a cross-sectional view taken substantially along the plane indicated by line 2—2 of FIG. 1.
Figure 3:
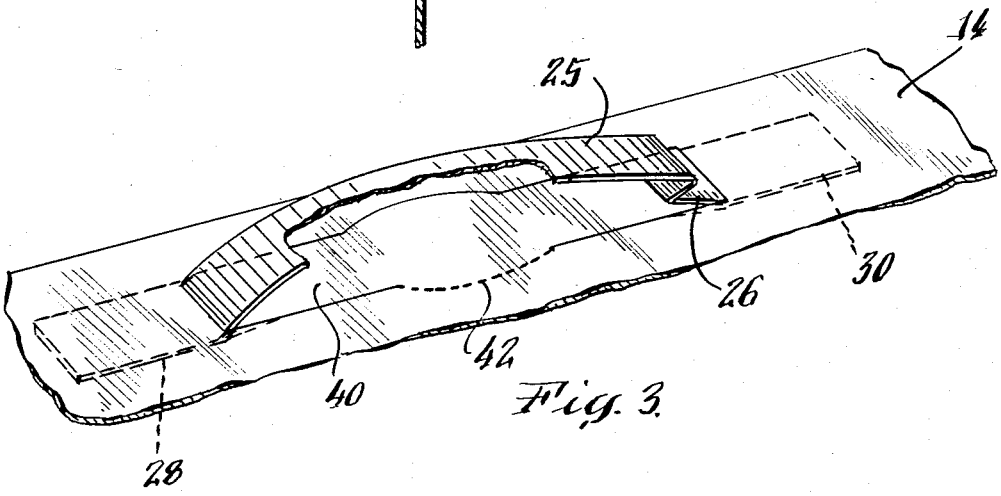
FIG. 3 is a perspective view, with portions partially broken away, of the handle construction on the carton of FIG. 1.
Figure 4:
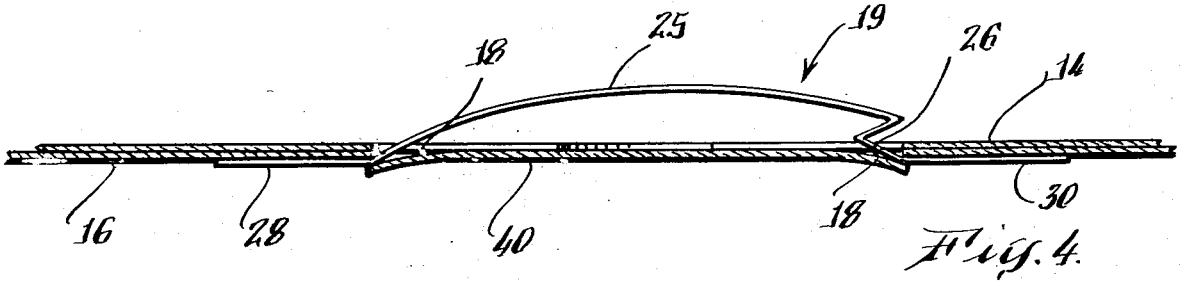
FIG. 4 is a cross-sectional view taken substantially along the plane indicated by line 4—4 of FIG. 1.

Referring to the drawings in detail, wherein like numerals indicate like elements throughout the several views, a carton 10 is provided with a top closure 12 including a pair of overlapping closure flaps 14 and 16 which are adhesively connected together.

Each of the flaps 14 and 16 have a centrally located opening 18, which when the flaps are overlapped are complementally aligned. Connected to the inner or rear surface of the closure flap 16 is a plastic handle structure generally designated by the numeral 19.

The handle structure 19 includes a plastic strip 25 such as "Tyvek", having an accordian bend or pleat 26 at one end to provide slack so that a greater amount of strip material can be provided in openings 18 which when extended upwardly will allow a hand therethrough to carry the carton. End portions 28 and 30 of strip 25 are adhesively secured to the rear or inner surface of lower flap 16 adjacent its opening 18, and the plastic strip 25 is then extended through the opening 18 in the flap. Closure flap 14 is then secured to the top surface of closure flap 16 and the strip 25 of handle 19 extends through the complemental openings 18 thereof.

In order to preclude contaminants from entering carton 10 through complemental openings 18 in closures flaps 14 and 16, a panel 40, generally complemental in shape to openings 18 is hingedly connected along an arcuate line or hinge 42 to lower flap 16 to close openings 18 and preclude communication with the interior of carton 10. Panel 40 is folded downwardly about hinge 42 and then strip 25 applied to flap 16. The panel 40 then is folded back to its original position closing opening 18.

In use, the accordion pleat 26 at one end of plastic strip 25 enables it to be extended and raised upwardly through complemental openings 18 where it can be grasped by the hand in order to carry the carton. The top panel 40 precludes dirt or other contaminants from entering the interior of the carton 10.

What is claimed as new is:

1. A carton, comprising:

a top closure including inner and outer overlapping flaps, each of said flaps having an identically shaped and coaxially aligned opening therein, said opening in said outer flap being completely open;

a carrying handle having opposite ends secured to an inner surface of said inner flap adjacent said opening therein and a central portion extending upwardly through said openings; and a panel shaped identically to said opening in said inner flap and hingedly coupled to said inner flap along a curved fold line defining a portion of said opening in said inner flap, said panel being pivotable between an open position permitting said handle to pass through said opening in said inner flap and a closed position substantially sealing said opening in said inner and outer flaps.

2. A carton according to claim 1 wherein said handle comprises a strip of material and said opposite ends thereof are adhesively bonded to said inner flap.

3. A carton according to claim 2 wherein said handle includes an accordian pleat.

4. A carton according to claim 2 wherein said strip of material is plastic.

5. A carton according to claim 1 wherein each of said openings has an elongated, substantially rectangular section and two substantially semi-circular sections extending outwardly from middle portions of longer sides of said rectangular section.

6. A carton according to claim 5 wherein said fold line extends along one of said semi-circular sections in said inner flap.

* * * * *